US012767311B2

(12) United States Patent
Parzybut et al.

(10) Patent No.: US 12,767,311 B2
(45) Date of Patent: Oct. 20, 2026

(54) HULL ASSEMBLY FOR A WATERCRAFT HAVING AN ACOUSTIC PANEL AND WATERCRAFT HAVING SAME

(71) Applicant: BOMBARDIER RECREATIONAL PRODUCTS INC., Valcourt (CA)

(72) Inventors: Jeremy Parzybut, Sherbrooke (CA); Maxime Bolduc, Sherbrooke (CA); Robert Lachance, Valcourt (CA); Jonathan Larose, Waterloo (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 812 days.

(21) Appl. No.: 18/161,294

(22) Filed: Jan. 30, 2023

(65) Prior Publication Data

US 2023/0242234 A1 Aug. 3, 2023

Related U.S. Application Data

(60) Provisional application No. 63/305,067, filed on Jan. 31, 2022.

(51) Int. Cl.
*B63H 21/30* (2006.01)

(52) U.S. Cl.
CPC ..... *B63H 21/305* (2013.01)

(58) Field of Classification Search
CPC ..... B63H 21/305; B63B 34/10; F02B 61/045; F02B 77/13
See application file for complete search history.

(56) References Cited

U.S. PATENT DOCUMENTS

| | | | | |
|---|---|---|---|---|
| 11,634,195 | B1 | 4/2023 | Dupuis et al. | |
| 2002/0022416 | A1* | 2/2002 | Lecours | B63B 34/10 440/88 L |
| 2003/0047379 | A1* | 3/2003 | Lecours | B63H 21/30 181/204 |

* cited by examiner

*Primary Examiner* — Andrew Polay
(74) *Attorney, Agent, or Firm* — BCF LLP

(57) ABSTRACT

A watercraft includes a deck, a hull, an engine assembly disposed in the engine compartment and including an engine, a drive system powered by the engine, and at least one acoustic panel. The hull partly defines an engine compartment having an engine compartment length. The engine has an engine length that is less than half of the engine compartment length. The at least one acoustic panel is disposed in the engine compartment to partially divide the engine compartment into a plurality of sub-compartments. In a vertical plane perpendicular to a longitudinal centerplane of the watercraft and extending through the at least one acoustic panel, the at least one acoustic panel occupies part of at least a majority of the cross-sectional area of the engine compartment that is not occupied by an engine assembly cross-sectional area, which is defined by a projection of the engine assembly on the vertical plane.

10 Claims, 12 Drawing Sheets

HULL ASSEMBLY FOR A WATERCRAFT HAVING AN ACOUSTIC PANEL AND WATERCRAFT HAVING SAME

CROSS-REFERENCE TO RELATED APPLICATION

The present application claims priority to U.S. Provisional Patent Application No. 63/305,067, filed Jan. 31, 2022 entitled "Hull Assembly for a Watercraft Having an Acoustic Panel and Watercraft Having Same", which is incorporated by reference herein in its entirety.

FIELD OF TECHNOLOGY

The present technology relates to watercraft and to hull assemblies thereof.

BACKGROUND

Many watercraft are equipped with internal combustion engines to power their propulsion systems. For instance, in some watercraft, the engine is disposed within an engine compartment formed by the watercraft's hull along with other components that assist the functions of the engine (e.g., a fuel tank, an air intake system, etc.).

However, in many cases, the engine's position within the engine compartment can lead to a significant of amount of noise and/or vibration being generated within the engine compartment, which can cause discomfort to the passengers present on the watercraft. This can especially be problematic for watercraft having large engine compartments, notably due to increased acoustic resonance. This problem can further be exacerbated in watercraft having flat decks.

In view of the foregoing, there is a need for a watercraft that addresses at least some of these drawbacks.

SUMMARY

It is an object of the present technology to ameliorate at least some of the inconveniences present in the prior art.

In one aspect of the present technology, there is provided a watercraft. The watercraft includes a deck, a hull, an engine assembly, a drive system and at least one acoustic panel. The hull supports the deck, and at least partly defines an engine compartment, which has an engine compartment length measured along a longitudinal direction of the watercraft. The engine assembly includes at least an internal combustion engine, and is disposed in the engine compartment. The engine has an engine length measured along the longitudinal direction of the watercraft. The engine length is less than half of the engine compartment length. The drive system is connected to the hull and is configured for propelling the watercraft. The drive system is operatively connected to the engine in order to be powered by the engine. The at least one acoustic panel is disposed in the engine compartment to partially divide the engine compartment into a plurality of sub-compartments in communication with one another. The at least one acoustic panel extends generally perpendicular to a longitudinal centerplane of the watercraft. In a vertical plane perpendicular to the longitudinal centerplane and extending through the at least one acoustic panel, the at least one acoustic panel occupies part of a cross-sectional area of the engine compartment. A projection of the engine assembly on the vertical plane defines an engine assembly cross-sectional area. The part of the cross-sectional area of the engine compartment that is occupied by the at least one acoustic panel corresponds to at least a majority of the cross-sectional area of the engine compartment that is not occupied by the engine assembly cross-sectional area.

In some embodiments, the at least one acoustic panel is connected to the hull.

In some embodiments, an upper portion of the at least one acoustic panel is connected to a connecting portion of the watercraft in order to hang the at least one acoustic panel from the connecting portion.

In some embodiments, the connecting portion is a cross-beam extending generally perpendicular to the longitudinal centerplane of the watercraft, the cross-beam being connected to the hull.

In some embodiments, the engine assembly further includes at least one of a fuel tank fluidly connected to the engine to provide fuel to the engine, an airbox fluidly connected to the engine to provide air to the engine, a muffler fluidly connected to the engine for reducing noise emitted by the engine, a resonator fluidly connected to the engine for altering noise emitted by the engine, and an engine control module in communication with the engine for controlling operation of the engine.

In some embodiments, the at least one acoustic panel defines a lower central recess configured to receive a portion of the engine assembly therein so that the at least one acoustic panel at least partially surrounds the engine assembly.

In some embodiments, the at least one acoustic panel is made of fire-resistant and waterproof foam.

In some embodiments, each acoustic panel of the at least one acoustic panel includes a first section and a second section disposed laterally adjacent to one another to form the acoustic panel.

In some embodiments, the first and second sections are identical.

In some embodiments, the at least one acoustic panel includes a first acoustic panel and a second acoustic panel, the first and second acoustic panels being spaced from one another along the longitudinal direction of the watercraft.

In some embodiments, the plurality of sub-compartments is three sub-compartments.

In some embodiments, one of the plurality of sub-compartments is an intermediate sub-compartment defined between the first and second acoustic panels, and at least a majority of the internal combustion engine is disposed in the intermediate sub-compartment.

In some embodiments, the deck above the engine compartment is substantially flat.

In some embodiments, the drive system is a jet propulsion system.

In some embodiments, the internal combustion engine is mounted directly to the hull.

In some embodiments, the deck includes an access panel configured to permit access to the engine.

In some embodiments, the part of the cross-sectional area of the engine compartment that is occupied by the at least one acoustic panel corresponds to at least an entirety of the cross-sectional area of the engine compartment that is not occupied by the engine assembly cross-sectional area.

In some embodiments, the part of the cross-sectional area of the engine compartment that is occupied by the at least one acoustic panel overlaps part of the engine assembly cross-sectional area.

According to another aspect of the present technology, there is provided a hull assembly for a watercraft. The hull assembly includes a hull, an engine assembly, a drive system and at least one acoustic panel. The hull defines an engine compartment. The engine assembly includes at least an internal combustion engine that is disposed in the engine compartment. The drive system is connected to the hull and is configured for propelling the watercraft. The drive system is operatively connected to the engine in order to be powered by the engine. The at least one acoustic panel is disposed in the engine compartment to partially divide the engine compartment into a plurality of sub-compartments in communication with one another. The at least one acoustic panel extends generally perpendicular to a longitudinal centerplane of the hull assembly. In a vertical plane perpendicular to the longitudinal centerplane of the hull assembly and extending through the at least one acoustic panel, the at least one acoustic panel occupies part of a cross-sectional area of the engine compartment. A projection of the engine assembly on the vertical plane defines an engine assembly cross-sectional area. The part of the cross-sectional area of the engine compartment that is occupied by the at least one acoustic panel corresponds to at least a majority of the cross-sectional area of the engine compartment that is not occupied by the engine assembly cross-sectional area.

In some embodiments, the at least one acoustic panel is connected to the hull.

In some embodiments, the engine assembly further includes at least one of a fuel tank fluidly connected to the engine to provide fuel to the engine, an airbox fluidly connected to the engine to provide air to the engine, a muffler fluidly connected to the engine for reducing noise emitted by the engine, a resonator fluidly connected to the engine for altering noise emitted by the engine, and an engine control module in communication with the engine for controlling operation of the engine.

In some embodiments, the at least one acoustic panel defines a lower central recess configured to receive a portion of the engine assembly therein so that the at least one acoustic panel at least partially surrounds the engine assembly.

In some embodiments, the at least one acoustic panel is made of fire-resistant and waterproof foam.

In some embodiments, each acoustic panel of the at least one acoustic panel includes a first section and a second section disposed laterally adjacent to one another to form the acoustic panel.

In some embodiments, the first and second sections are identical.

In some embodiments, the at least one acoustic panel includes a first acoustic panel and a second acoustic panel, the first and second acoustic panels being spaced from one another along the longitudinal direction of the hull.

In some embodiments, the plurality of sub-compartments is three sub-compartments.

In some embodiments, one of the plurality of sub-compartments is an intermediate sub-compartment defined between the first and second acoustic panels, and at least a majority of the internal combustion engine is disposed in the intermediate sub-compartment.

In some embodiments, the drive system is a jet propulsion system.

In some embodiments, the internal combustion engine is directly mounted to the hull.

In some embodiments, the part of the cross-sectional area of the engine compartment that is occupied by the at least one acoustic panel corresponds to at least an entirety of the cross-sectional area of the engine compartment that is not occupied by the engine assembly cross-sectional area.

In some embodiments, the part of the cross-sectional area of the engine compartment that is occupied by the at least one acoustic panel overlaps part of the engine assembly cross-sectional area.

According to another aspect of the present technology, there is provided a watercraft including a deck, a hull, an engine assembly, a drive system and at least one acoustic panel. The hull supports the deck, and at least partly defining an engine compartment. The engine assembly is disposed in the engine compartment, and includes an internal combustion engine, a fuel tank fluidly connected to the engine to provide fuel to the engine, and a muffler fluidly connected the engine for reducing noise emitted by the engine. The drive system is connected to the hull and is configured for propelling the watercraft. The drive system is operatively connected to the engine in order to be powered by the engine. The at least one acoustic panel is disposed in the engine compartment to partially divide the engine compartment into a plurality of sub-compartments in communication with one another. The at least one acoustic panel extends in part above the engine assembly and on both sides of a longitudinal centerplane of the watercraft in order to at least partially surround the engine assembly. Each acoustic panel of the at least one acoustic panel has a panel height that is greater than at least half of a height of the hull.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
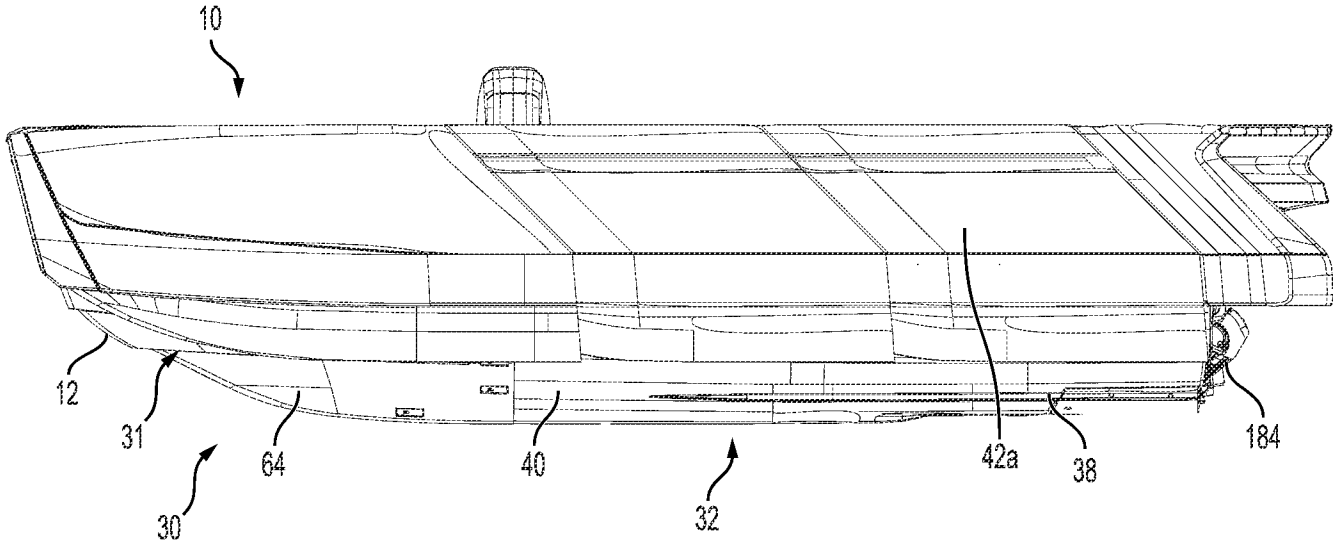
FIG. 1 is a left side elevation view of a pontoon boat in accordance with an embodiment of the present technology.
Figure 2:
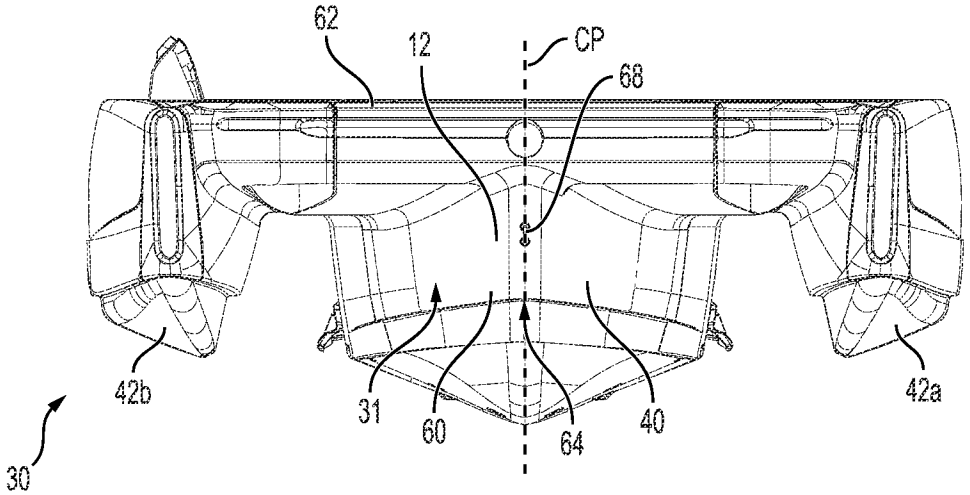
FIG. 2 is a front elevation view of the pontoon boat of FIG. 1.
Figure 3:
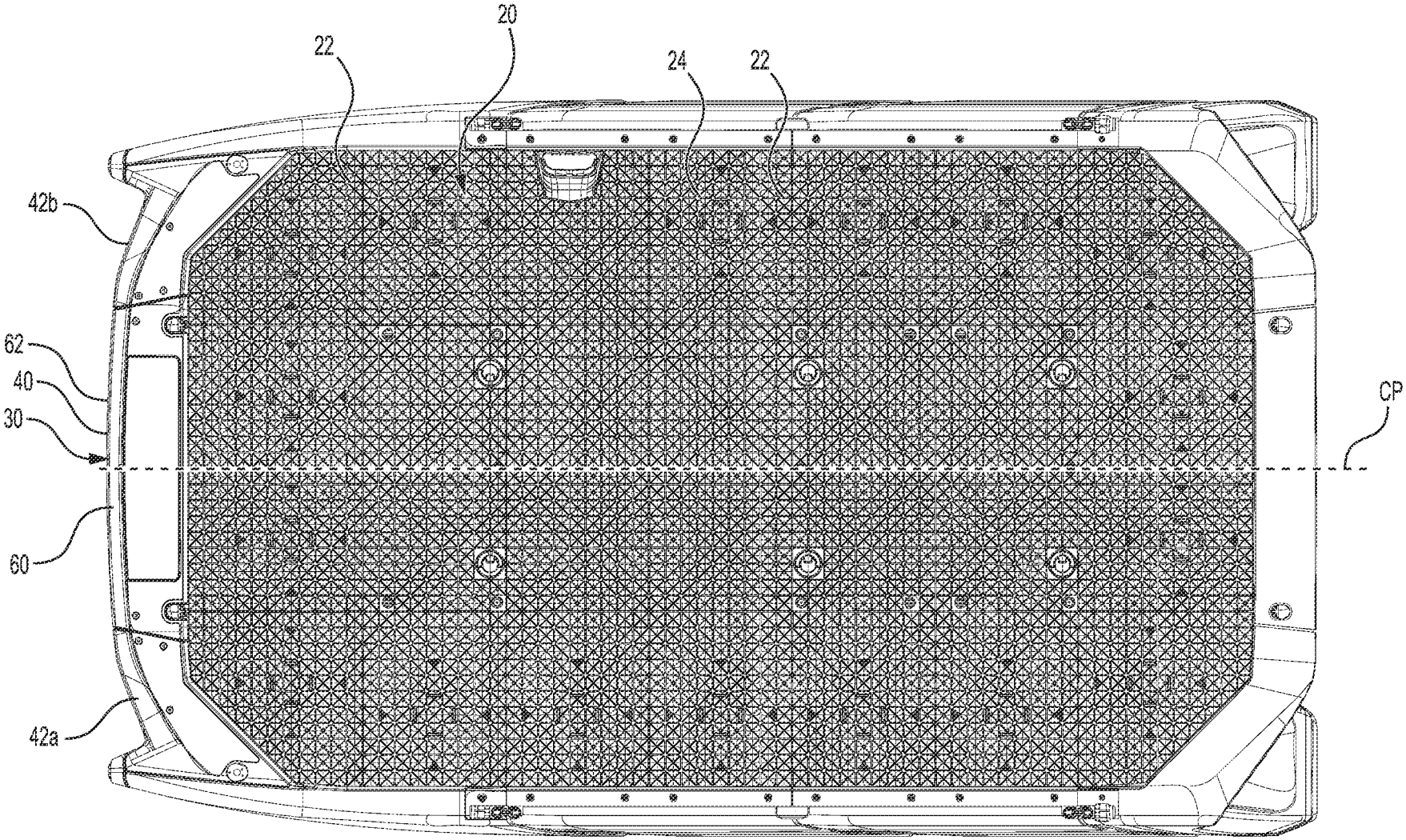
FIG. 3 is a top plan view of the pontoon boat of FIG. 1.

A watercraft 10 in accordance with an embodiment of the present technology is shown in FIGS. 1 to 3. The following description relates to one example of a watercraft 10, notably a pontoon boat 10. Those of ordinary skill in the art will recognize that there are other known types of watercraft incorporating different designs and that the present technology would encompass these other watercraft. For instance, it is contemplated that a personal watercraft (PWC) and other types of watercraft could also implement the present technology.

In this embodiment, the boat 10 has a deck 20 and a hull 30 supporting the deck 20. The deck 20, which is generally flat, extends above the hull 30 and has an upper surface 24 for supporting occupants, as well as accessories and accommodations of the boat 10 (e.g., seating, a command console with vessel controls such as steering and throttle controls, etc.) that have been omitted for clarity. In this embodiment, as best seen in FIG. 3, the deck 20 includes a plurality of tiles 22 which are configured for attachment of accessories thereto. The tiles 22 form a portion of the upper surface 24 of the deck 20. Notably, a number of the tiles 22 extend over the left hull 42*a*, some over the right hull 42*b* and some others over the central hull 40. A more detailed description of the configuration of the tiles 22 and the manner in which they are used for attachment of accessories can be found in U.S. patent application Ser. No. 16/887,481, filed May 29, 2020.

It is contemplated that the deck 20 could have a different construction than that provided by the tiles 22. For instance, the deck 20 could have a more conventional construction such as including a metallic frame and an overlying flooring layer, such as wooden panels or plywood.

In this embodiment, the hull 30 is a multihull watercraft, notably having a central hull 40, a left hull 42*a* and a right hull 42*b*. The left and right hulls 42*a*, 42*b* are laterally spaced apart from one another and are separated by the central hull 40 that is laterally centered therebetween and to which both the left and right hulls 42*a*, 42*b* are connected. Thus, the central hull 40 is centered along a longitudinal centerplane CP of the boat 10. It is contemplated that, in other embodiments, the boat 10 may not be a multihull watercraft and may instead have a single hull, such as the central hull 40. In this embodiment, the central hull 40 and the lateral hulls 42*a*, 42*b* of the boat 10 are constructed modularly so as to simplify the production and assembly of various length hulls based on common components. In some embodiments, the central and lateral hulls 40, 42*a*, 42*b* could be one integral component.

More specifically, the lateral hulls 42*a*, 42*b* of the boat 10 are assembled from a plurality of "modules", the number of which determines the length of each of the lateral hulls 42*a*, 42*b*. Briefly, each of the lateral hulls 42*a*, 42*b* includes a plurality of braces (not shown) and buoyant elements (not shown) to respectively provide rigidity and buoyancy to the lateral hulls 42*a*, 42*b*. It is contemplated that, in other embodiments, the lateral hulls 42*a*, 42*b* may not be constructed modularly but may instead each be an integral component.

With continued reference to FIGS. 1 to 3, in this embodiment, the central hull 40 of the boat 10 includes only two modules that are attached to one another to form the central hull 40. In particular, the central hull 40 includes a front hull module 31 and a rear hull module 32 connected to the front hull module 31. It is contemplated that in some embodiments, the central hull 40 could include three or more modules. It is also contemplated that in some embodiments, the central hull 40 may not be constructed modularly, but may instead be a single integral component.

The front hull module 31 includes a front hull panel 60 which defines a bow 12 of the boat 10. The front hull panel 60 has an upper portion 62 and a lower portion 64 extending below the upper portion 62. As can be seen in FIG. 3, the upper portion 62 of the front hull panel 60 defines part of a front upper periphery of the boat 10. The lower portion 64 of the front hull panel 60 is configured to deflect water toward either side thereof as the boat 10 moves in a forward direction. To that end, the lower portion 64 is generally V-shaped. A tow eye 68 (FIG. 2) protrudes forwardly from the front hull panel 60.

Figure 4:
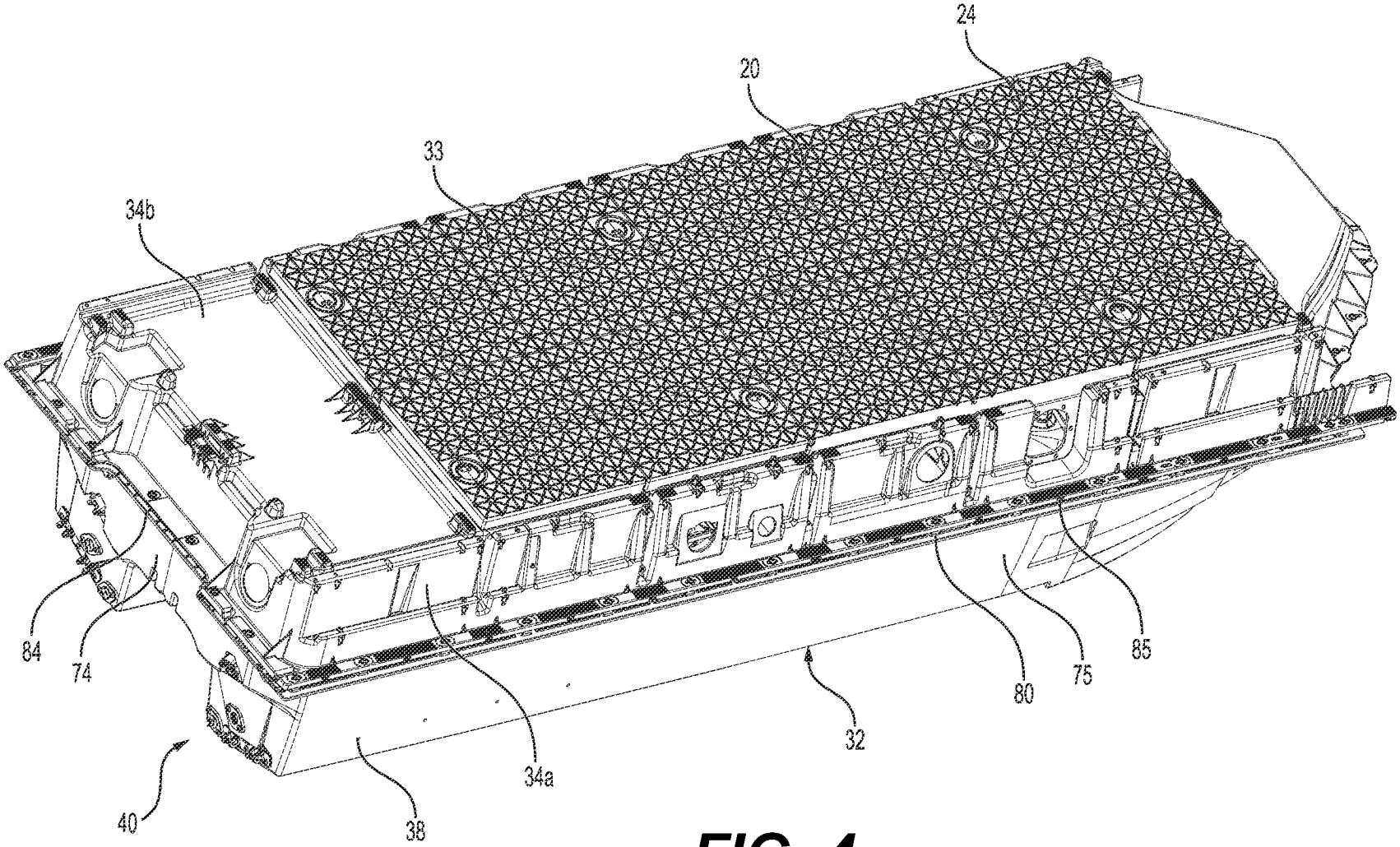
FIG. 4 is a perspective view, taken from a top, rear, right side, of part of the pontoon boat of FIG. 1, including a rear hull module of a central hull and a portion of a deck of the pontoon boat.
Figure 8:
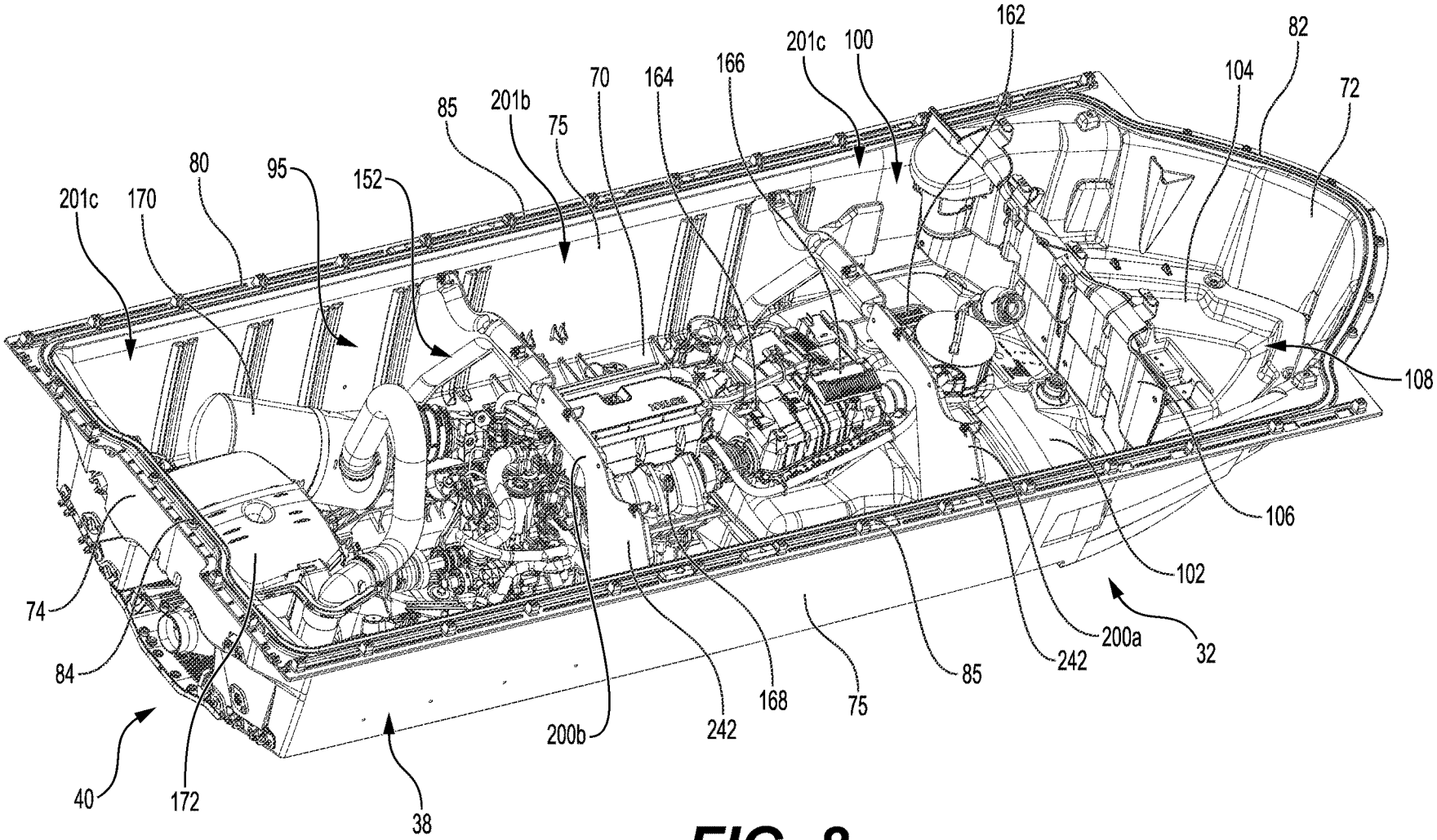
FIG. 8 is a perspective view, taken from a top, rear, right side, of a rear hull panel of the rear hull module, an engine assembly contained therein and acoustic panels.

Turning now to FIGS. 1, 4 and 8, the rear hull module 32 includes a rear hull panel 38 that is attached to a rear portion of the front hull panel 60. A shown in FIG. 6, the rear hull panel 38 has a lower wall 70, a front wall 72, a rear wall 74, and two opposite lateral walls 75. The front wall 72, the rear wall 74 and the lateral walls 75 extend upwardly from the lower wall 70. The walls 70, 72, 74, 75 of the rear hull panel 38 define an interior volume 95 of the rear hull panel 38 within which various components of the boat 10 are disposed as will be described in more detail below. As shown in FIG. 8, the rear hull panel 38 also has an upper peripheral edge 80 which defines an open upper end of the rear hull panel 38. The upper peripheral edge 80 of the rear hull panel 32 has a front portion 82, a rear portion 84 and two opposite lateral portions 85. In this embodiment, the rear portion 84 and the lateral portions 85 are rectilinear, whereas the front portion 82 is generally V-shaped (with a tip thereof pointing forwardly).

Figure 5:
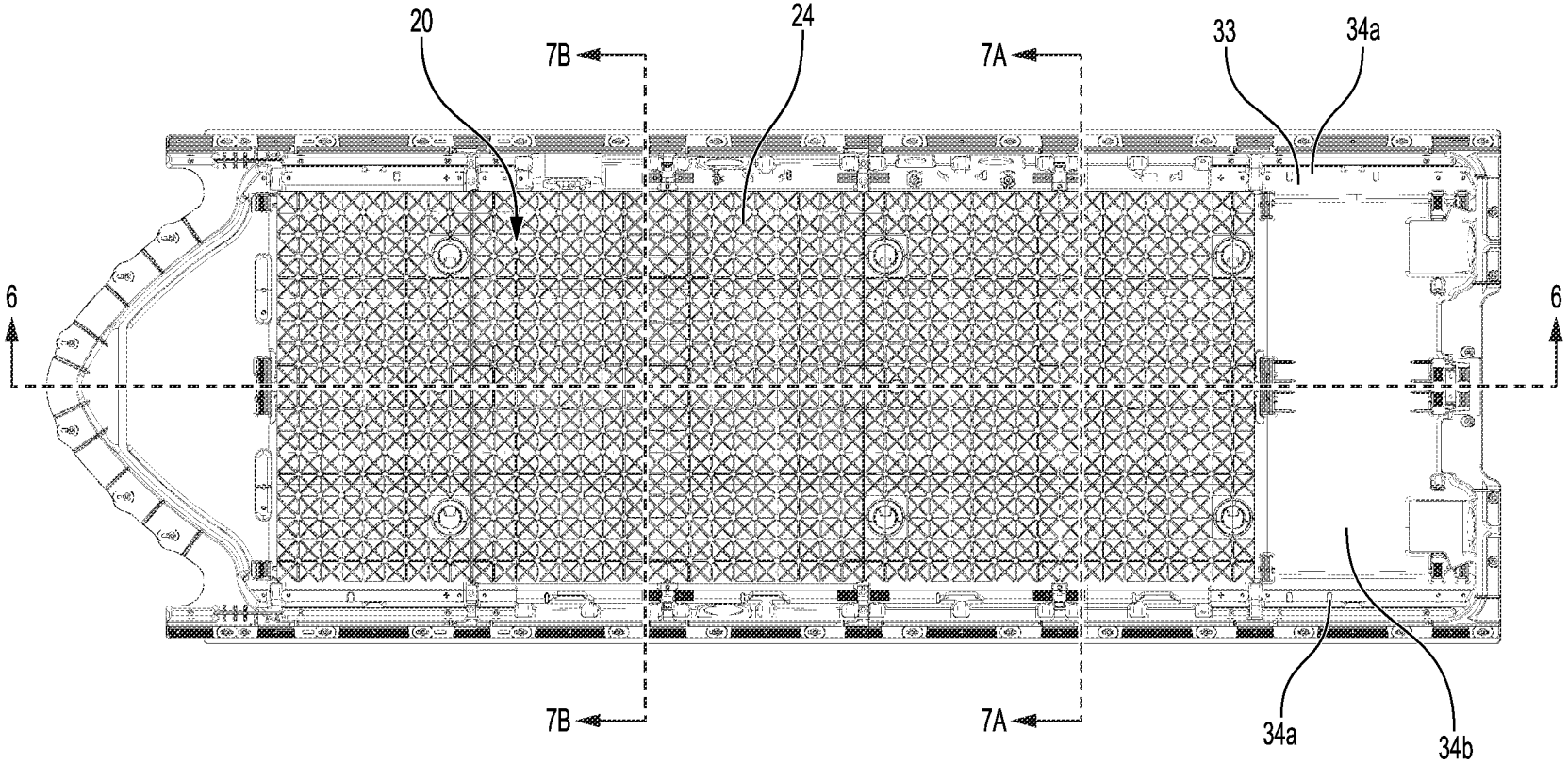
FIG. 5 is a top plan view of the part of the pontoon boat of FIG. 4.
Figure 6:
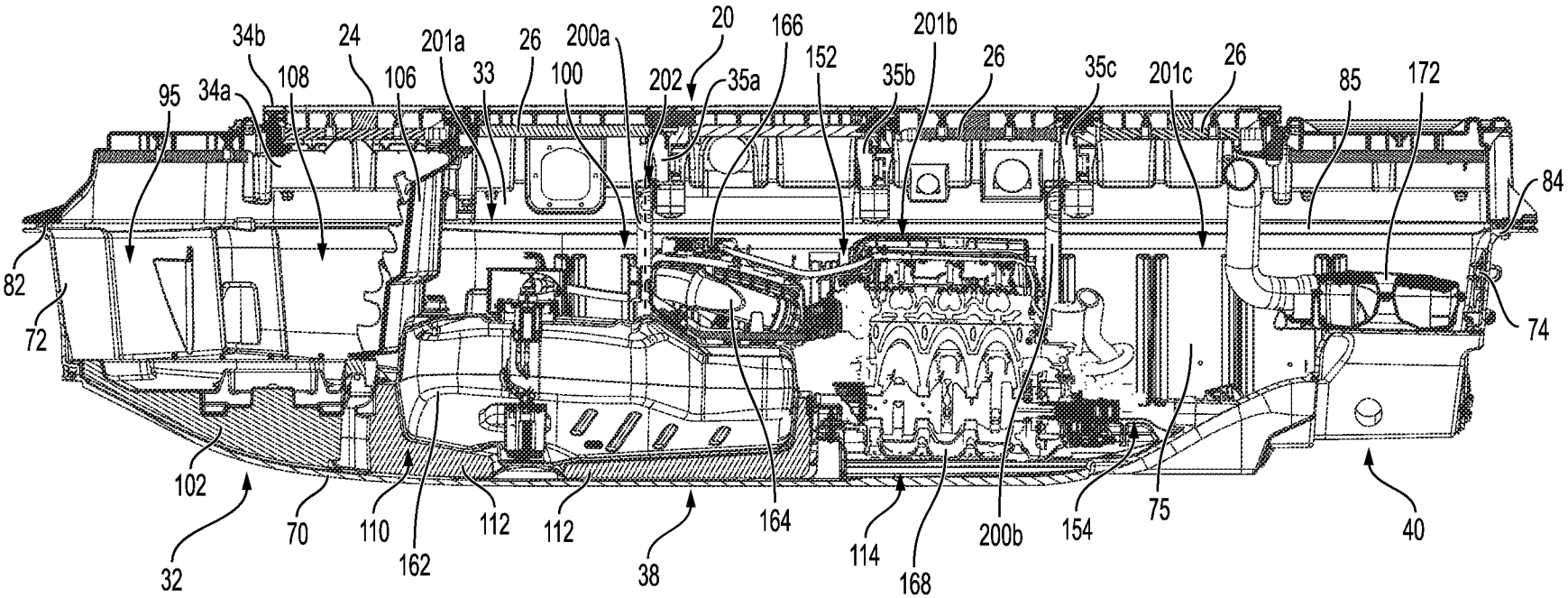
FIG. 6 is a cross-sectional view of the part of the pontoon boat of FIG. 4, taken along line 6-6 in FIG. 5.

Referring to FIGS. 4 to 6, the deck 20 has a rear hull cover 33 that is connected to the rear hull panel 38, namely to the upper peripheral edge 80 thereof, to enclose the interior volume 95 of the rear hull panel 38. The rear hull cover 33 has opposite lateral sections 34*a* that extend generally vertically from the upper peripheral edge 80 and a top section 34*b* extending between the lateral sections 34*a*. The deck 20 has a plurality of access panels 26 (FIG. 6) that are selectively connected to the top section 34*b* of the rear hull cover 33 for accessing the interior volume 95 of the rear hull panel 38.

Figure 7A:
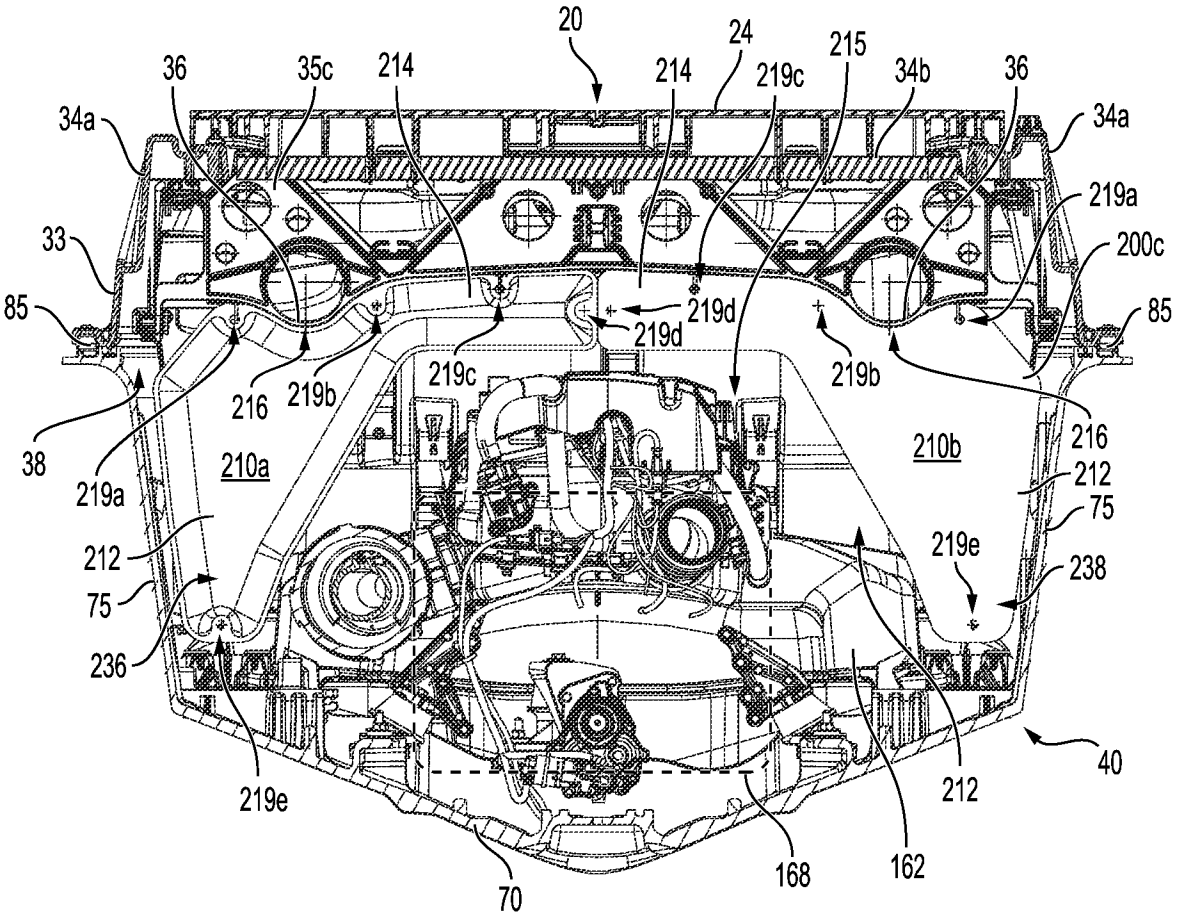
FIG. 7A is a cross-sectional view of the part of the pontoon boat of FIG. 4, taken along line 7A-7A in FIG. 5.
Figure 7B:
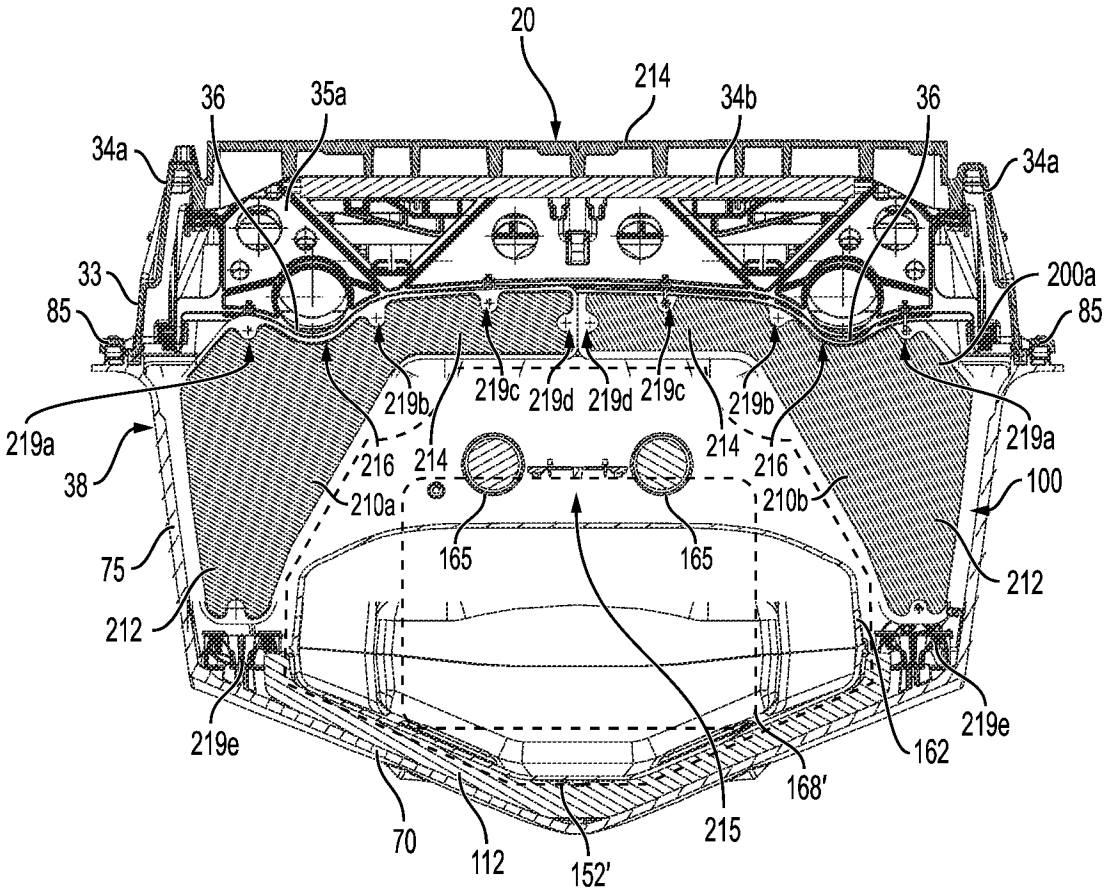
FIG. 7B is a cross-sectional view of the part of the pontoon boat of FIG. 4, taken along line 7B-7B in FIG. 5.

Turning to FIGS. 6, 7A and 7B, in this embodiment, the boat 10 has, disposed below the upper surface 24 of the deck 20, a leading cross-beam 35*a*, an intermediate cross-beam 35*b* and a trailing cross-beam 35*c* for providing further rigidity to the hull 30. The leading, intermediate and trailing cross-beams 35*a*, 35*b*, 35*c*, which are longitudinally spaced from one another, are connected to and extend laterally between the opposite lateral sections 34*a* of the rear hull cover 33. The leading, intermediate and trailing cross-beams 35*a*, 35*b*, 35*c* extend generally perpendicular to the longitudinal centerplane CP. It is contemplated that in other embodiments, there could be more or fewer than three cross-beams.

Figure 9:
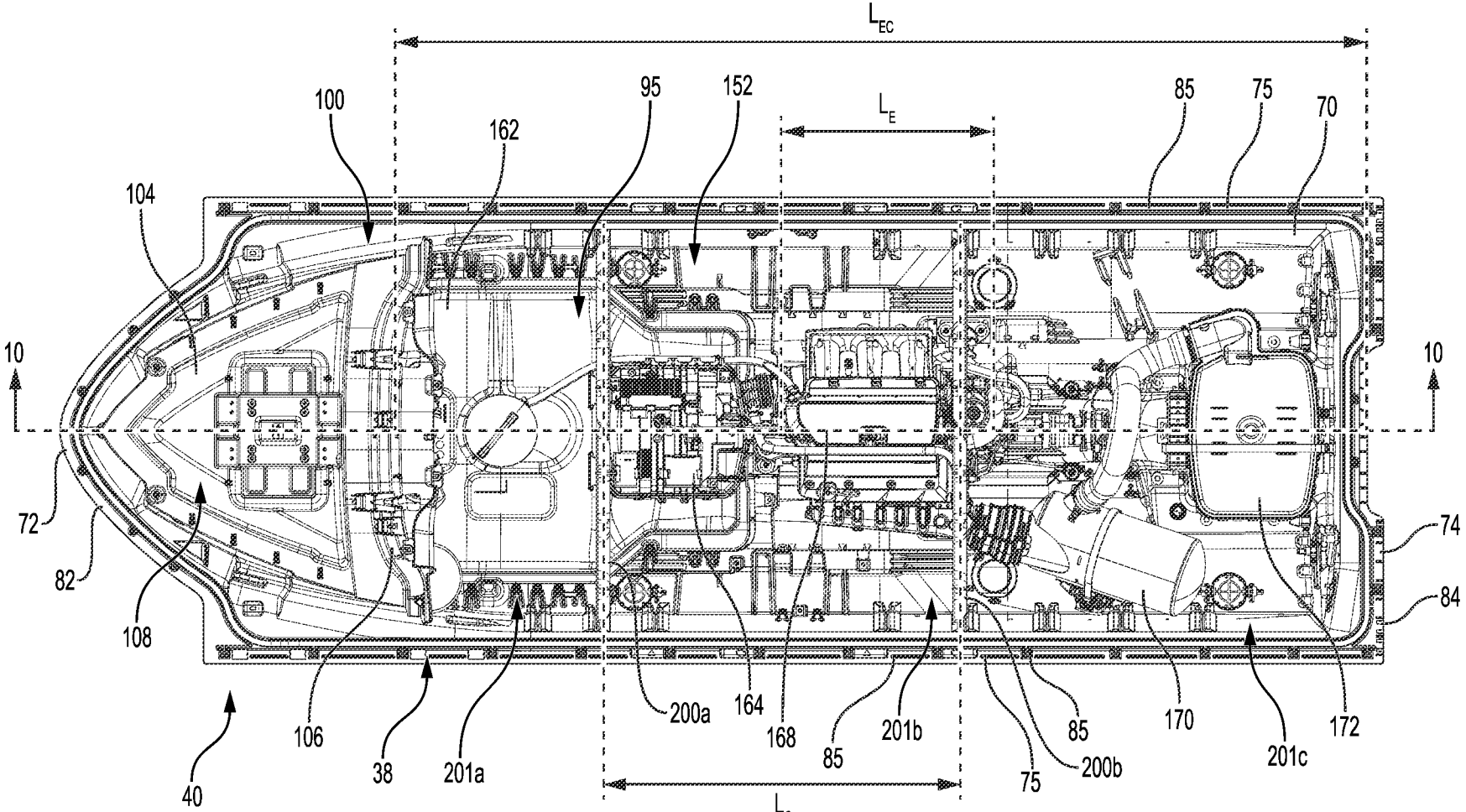
FIG. 9 is a top plan view of the rear hull panel, the engine assembly and the acoustic panels of FIG. 8.
Figure 10:
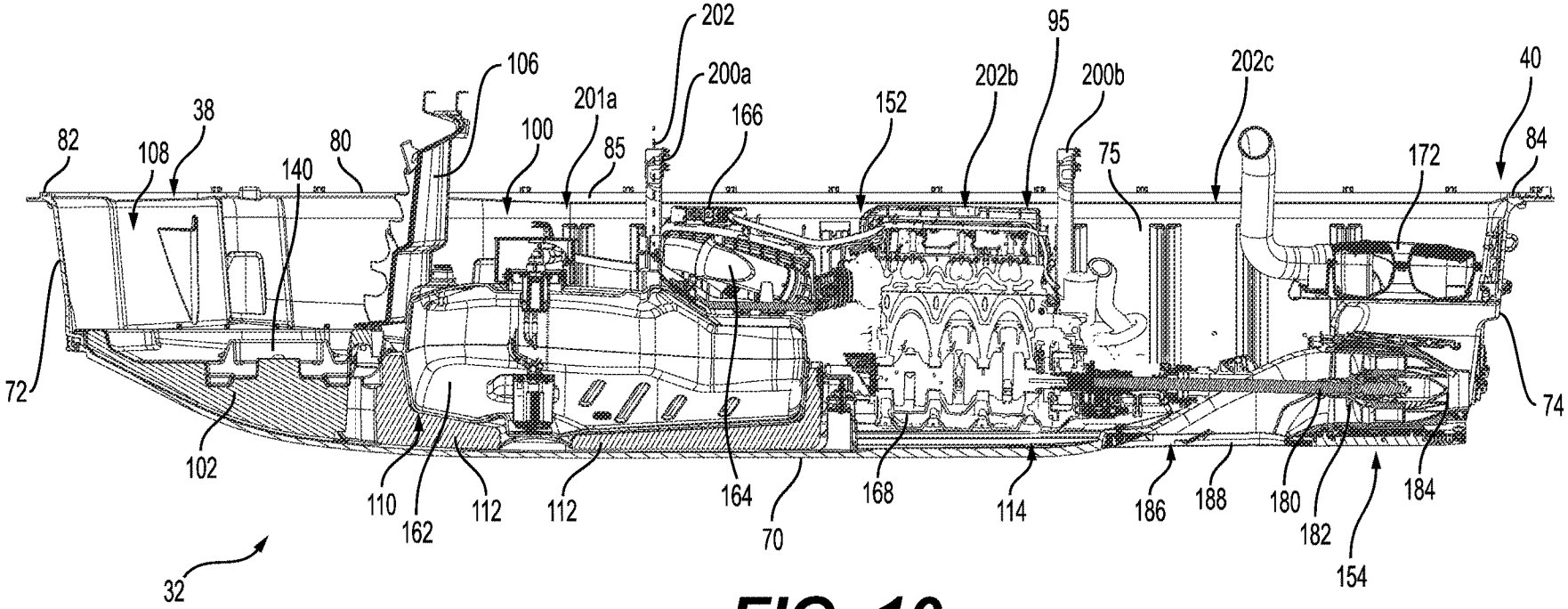
FIG. 10 is a cross-sectional view of the rear hull panel, the engine assembly and the acoustic panels of FIG. 8, taken along line 10-10 in FIG. 9.

With reference to FIGS. 6, 9 and 10, in this embodiment, the interior volume 95 of the rear hull panel 38 is divided into a storage compartment 108 and an engine compartment 100 disposed rearwardly of the storage compartment 108. Notably, in this embodiment, a bulkhead 106 is connected to the rear hull panel 38 between the lateral walls 75 and defines a front end of the engine compartment 100 and a rear end of the storage compartment 108. More particularly, the storage compartment 108 is defined by the lower wall 70, the front wall 72, front portions of the lateral walls 75 and a front surface of the bulkhead 106. The engine compartment 100 is defined by the walls 70, 75, 76 of the rear hull panel 38, the rear surface of the bulkhead 106 and, at its upper end, by the rear hull cover 33. It is contemplated that in some embodiments, the bulkhead 106 and/or the storage compartment 108 could be omitted.

As shown in FIG. 9, in this embodiment, the engine compartment 100 has an engine compartment length $L_{EC}$ measured along a longitudinal direction of the boat 10 (i.e., parallel to the longitudinal centerplane CP) that is significant.

The engine compartment 100 receives various components of the boat 10 therein. Notably, and with continued reference to FIGS. 6 to 10, the engine compartment 100 receives an engine assembly 152 (which may be referred to as a "power pack") which includes an internal combustion engine 168 and a number of components that interface with the engine 168 to support its functionality. In particular, in this embodiment, in addition to the engine 168, the engine assembly 152 includes a fuel tank 162 positioned in front of the engine 168, an airbox 164 mounted atop the fuel tank 162, an engine control module 166 mounted atop the airbox 164, a muffler 170 mounted behind the engine 168 and a resonator 172 also mounted behind the engine 168. The positioning and functionality of these components will be described in more detail below. It is contemplated that the engine assembly 152 could include more or fewer components and/or that some of these components could be disposed elsewhere than in the engine compartment 100 (e.g., on the deck 20) or omitted.

As shown in FIG. 10, in this embodiment, buoyant elements 102, 112 are disposed within the interior volume 95 of the rear hull panel 32. For instance, a buoyant element 102 is disposed within the storage compartment 108, on the lower wall 70 of the rear hull panel 38. A cover 104 is disposed atop the buoyant element 102 and is connected to the rear hull panel 38 (e.g., by fasteners). It is contemplated that in other embodiments, the cover 104 could be connected differently, such as, for instance, with an adhesive. Similarly, a buoyant element 112 is disposed in the engine compartment 100, below the fuel tank 162. The buoyant element 112 is shaped and sized to conform to the bottom of the fuel tank 162. In this embodiment, the buoyant elements 102, 112 are made of a closed-cell foam material and may thus be referred to as a "foam block". It is contemplated that the buoyant element 102 could be made of any other suitable foam material in other embodiments. Moreover, it is contemplated that the buoyant element 102 could consist of other types of buoyant elements in other embodiments (e.g., an inflatable bladder, a plastic container, etc.).

With continued reference to FIG. 10, in this embodiment, the fuel tank 162 is partially received in a fuel tank receiving recess 110 defined by the buoyant element 112, which extends below and partially around the fuel tank 162. The fuel tank 162 is configured to store fuel therein and is fluidly connected to the engine 168 to provide fuel thereto. The airbox 164 is disposed atop a rear portion of the fuel tank 162. The airbox 164 is fluidly connected to the engine 168 to provide air thereto. The engine control module 166 is disposed atop the airbox 164 and is communicatively connected to the engine 168 and to a throttle lever (not shown) for controlling operation of the engine 168. The throttle lever (not shown) is disposed on a command console (not shown) disposed on the deck 20.

The rear hull panel 38 defines an engine receiving portion 114 rearwardly from the fuel tank 162, the airbox 164 and the engine control module 166. The engine 168 is disposed in the engine receiving portion 114 and is directly mounted to the lower wall 70 of the rear hull panel 38 by engine mounts (not shown). As can be seen in FIGS. 9 and 10, in this embodiment, the engine 168 has a length $L_E$ measured along the longitudinal direction of the boat 10 that is relatively small compared to the engine compartment length $L_{EC}$. Notably, in this embodiment, the length $L_E$ of the engine 168 is less than half of the engine compartment length $L_{EC}$ of the engine compartment. It is contemplated that in some embodiments, the length $L_E$ could be more or less than half of the engine compartment length $L_{EC}$. The engine compartment 100 being large relative to the engine 168 increases a volume in which sound waves can propagate, which can lead to loud noises and vibrations, notably due to acoustic resonance.

The engine 168 is operatively connected to a drive system 154 that is configured to propel the boat 10. In this embodiment, the drive system 154 is a jet propulsion system having an impeller 182. As shown in FIG. 10, the impeller 182 is disposed in a compartmentalized portion of the rear hull panel 38. A shaft 180 operatively connects the engine 168 to the impeller 182 in order to power the jet propulsion system 154. The rear hull panel 38 defines an inlet aperture 186 near a rear end of the rear hull panel 38. The inlet aperture 186 is covered in part by an inlet grate 188 for entry of water into the compartmentalized portion of the rear hull panel 38. Rotation of the impeller 182 causes water to be discharged through a steering nozzle 184 of the jet propulsion system 154 for propulsion of the boat 10. The steering nozzle 184 is controlled by a handlebar (not shown) that is located on the command console. It is contemplated that in some embodiments, the handlebar could be replaced by a steering wheel.

Referring to FIG. 9, the muffler 170 is disposed in the engine compartment 100 rearwardly from the engine 168. In particular, the muffler 170 is disposed on a rear, left side of the engine 168. The muffler 170 is fluidly connected to the engine 168 for reducing noise emitted by the engine 168. The resonator 172 is disposed rearwardly from the muffler 170 and is fluidly connected to the muffler 170, and thereby to the engine 168, for reducing noise emitted by the engine 168.

It is to be understood that the positions of the fuel tank 162, the airbox 164, the engine control module 166, the engine 168, the muffler 170 and the resonator 172 could vary from one embodiment to another without departing from the scope of the present technology. Additionally, more or fewer components could be disposed in the engine compartment 100. For instance, additional buoyant elements may be provided within the interior volume 95 of the rear hull panel 38. Furthermore, some components of the engine assembly 152 could be disposed outside of the engine compartment 100. For instance, in some embodiments, the engine control module 166 could be disposed on the deck 20.

With reference now to FIGS. 6 to 10, two acoustic panels 200*a*, 200*b* are also disposed within the engine compartment 100. The acoustic panels 200*a*, 200*b* are provided for attenuating sound and vibrations generated within the engine compartment 100 by operation of the engine assembly 152 and, in particular, the engine 168 itself. To that end, as will be described in detail below, the acoustic panels 200*a*, 200*b* are positioned to divide the engine compartment 100 into a plurality of sub-compartments 201*a*, 201*b*, 201*c* that are in communication with one another. The two acoustic panels 200*a*, 200*b* include a leading acoustic panel 200*a* and a trailing acoustic panel 200*b* that are longitudinally spaced from one another. It is contemplated that more or fewer acoustic panels could be provided in other embodiments. For instance, in some embodiments, a single acoustic panel may be provided. In other embodiments, three or more acoustic panels may be provided.

The acoustic panels 200*a*, 200*b* will now be described with particular reference to FIGS. 7A, 7B, 11 and 12. Since, in this embodiment, the leading and trailing acoustic panels 200*a*, 200*b* are identical, only the trailing acoustic panel 200*b* will be described in detail herein. It is to be understood that the leading acoustic panel 200*a* has a similar construction to that described in respect of the trailing acoustic panel 200*b*.

As shown in FIG. 7A, the acoustic panel 200*b* has a left acoustic panel section 210*a* and a right acoustic panel section 210*b*. The left and right acoustic panel sections 210*a*, 210*b* are disposed laterally adjacent to one another. It is contemplated that in some embodiments, the acoustic panel 200*a* could be one integral component. It is also contemplated that in some embodiments, the acoustic panel 200*a* could include three or more acoustic panel sections. In this embodiment, when the left and right acoustic panel sections 210*a*, 210*b* are disposed laterally adjacent to one another, the left and right acoustic panel sections 210*a*, 210*b* define a lower central recess 212 that is configured to receive a portion of the engine assembly 152 therein and that is configured to allow air flow therethrough.

While in this embodiment the left and right acoustic panel sections 210*a*, 210*b* are identical, it is contemplated that in some embodiments, the acoustic panel sections 210*a*, 210*b* could be different from one another. The left and right acoustic panel sections 210*a*, 210*b* being similar can help to reduce manufacturing costs. Since the left and right acoustic panel sections 210*a*, 210*b* are the same, only the left acoustic panel section 210*a* will be described herein.

Figure 11:
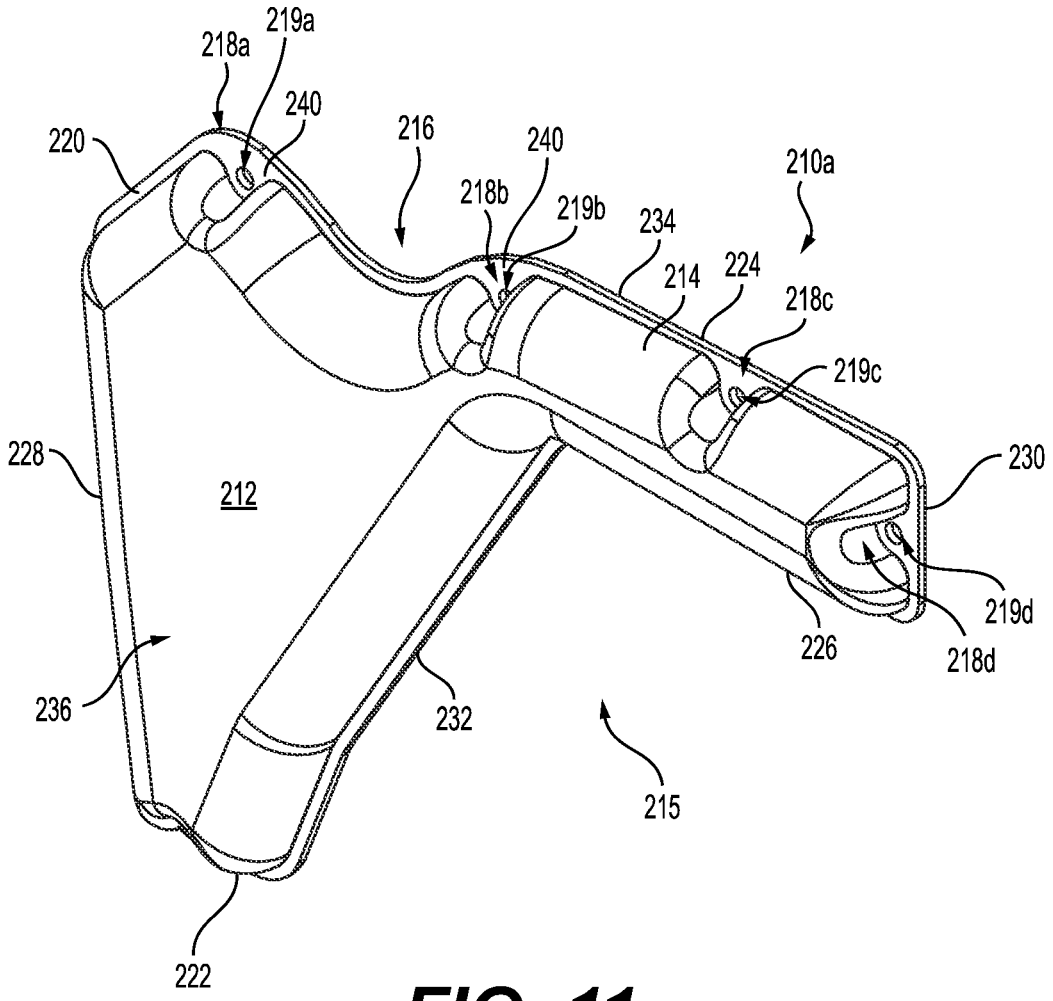
FIG. 11 is a perspective view, taken from a top, rear, right side, of an acoustic panel section of one of the acoustic panels of FIG. 8.
Figure 12:
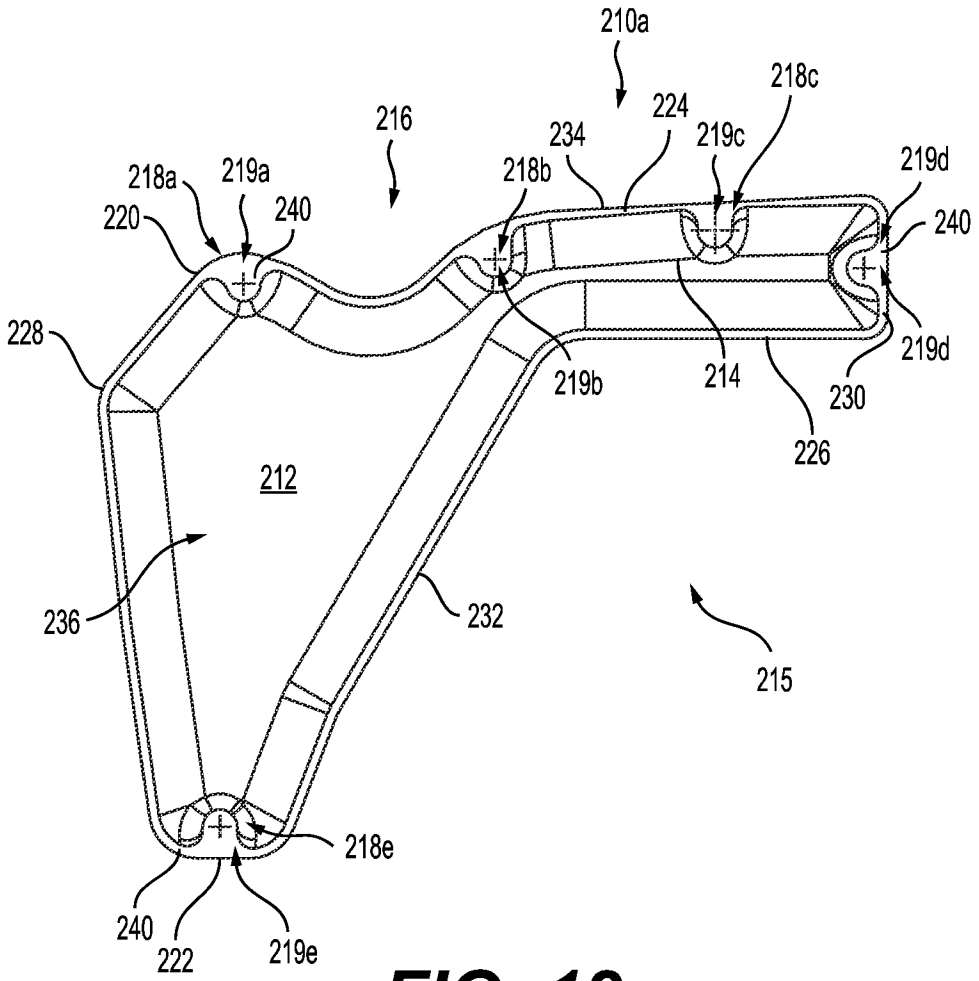
FIG. 12 is a rear elevation view of the acoustic panel section of FIG. 11.

As shown in FIGS. 11 and 12, the left acoustic panel section 210*a* has a side portion 212 and a top portion 214 extending laterally inwardly from the side portion 212. The side portion 212 has a top end 220 and a bottom end 222 opposite one another and defining a height of the side portion 212 therebetween. In this embodiment, the height of the side portion 212 is greater than a height of the top portion 214. That is, a distance between the top and bottom ends 220, 222 of the side portion 212 is greater than a distance between respective top and bottom ends 224, 226 of the top portion 214. In this embodiment, the height of the left acoustic panel section 210*a*, defined in a height direction between the bottom end 222 and the top end 224, is greater than half of the height of the rear hull panel 38. The acoustic panel section 210*a* also has an outer lateral end 228 defined by the side portion 212 and an inner lateral end 230 defined by the top portion 214. A width of the acoustic panel section 210*a* is defined between the outer and inner lateral ends 228, 230. The left acoustic panel section 210*a* defines an inner lateral recess 215 formed by an inner lateral edge 232 of the side portion 212 and the bottom end 226 of the top portion 214. As such, the inner lateral recess 215 is disposed laterally inwardly of the side portion 212 and below the top portion 214. In use, when the left acoustic panel section 210*a* is disposed adjacent to the right acoustic panel section 210*b*, the inner lateral recess 215 corresponds to half of the lower central recess 212 of the acoustic panel 200*a*.

As will be described in greater detail below, a top peripheral border portion 234 of the acoustic panel section 210*a*, defining the top ends 220, 224, is configured to connect to a portion of the trailing cross-beam 35*c*. To that end, in this embodiment, the top peripheral edge 234 of the left acoustic panel section 210*a* is configured to conform to a bottom of the corresponding part of the trailing cross-beam 35*c*. Notably, in this embodiment, along the side portion 212, the top peripheral edge 234 defines an upper recess 216 configured to receive a protrusion 36 (shown in FIG. 7A) of the cross-beam 35*a*.

In this embodiment, the acoustic panel section 210*a* also defines five connecting recesses 218*a*, 218*b*, 218*c*, 218*d*, 218*e* on a first longitudinal side 236 thereof (opposite a second longitudinal side 238 (FIG. 7A) of the acoustic panel section 210*a*). Each of the connecting recesses 218*a*, 218*b*, 218*c*, 218*d*, 218*e* is defined in part by a recess bottom surface 240 of the acoustic panel section 210*a*. The recess bottom surfaces 240 defining the connecting recesses 218*a*, 218*b*, 218*c*, 218*d*, 218*e* respectively define connecting apertures 219*a*, 219*b*, 219*c*, 219*d*, 219*e* which are configured to receive fasteners (not shown) therethrough. In some embodiments, there could be more or fewer than five recesses and/or apertures. In other embodiments, the recesses and/or the apertures could be omitted altogether, such as, for example, when the left acoustic panel section 210*a* is connected to the cross-beam 35*a* with an adhesive.

Returning to FIG. 7A, in this embodiment, the acoustic panel section 210*a* has a relatively flat surface 242 on the second longitudinal side 238 such that the second longitudinal side 238 is generally planar. It is contemplated that the second longitudinal side 238 could be configured differently in other embodiments.

In this embodiment, the acoustic panel 200*b* is made of a sound-absorbing material that is fire-resistant and waterproof. For instance, in this embodiment, the acoustic panel 200*b* is made of a foam material. It is understood that other materials besides foam could be used. It is contemplated that in other embodiments, the acoustic panel 200*b* could be made of a material that is only sound-absorbing, only fire-resistant and sound-absorbing, or only waterproof and sound-absorbing.

Referring back to FIGS. 6 to 10, in this embodiment, the leading acoustic panel 200*a* is connected to the leading cross-beam 35*a* while the trailing acoustic panel 200*b* is connected to the trailing cross-beam 35*c*. It is contemplated that in some embodiments, one of the leading and trailing acoustic panels 200*a*, 200*b* could instead be connected to the intermediate cross-beam 35*b*. In this embodiment, the leading and trailing acoustic panels 200*a*, 200*b* are connected to the leading and trailing cross-beams 35*a*, 35*c* by being hung therefrom. In particular, the leading and trailing acoustic panels 200*a*, 200*b* respectively hang from the leading and trailing cross-beams 35*a*, 35*c* via fasteners (not shown) which are received through the connecting apertures 219*a*, 219*b*, 219*c* and connected to the cross-beams 35*a*, 35*c*. In this embodiment, the fasteners are tie wraps. The leading and trailing acoustic panels 200*a*, 200*b* could be connected to the corresponding cross-beam by other connection methods such as with adhesives. Additionally, in this embodiment, the left and right acoustic panel sections 210*a*, 210*b* of a given one of the leading and trailing acoustic panels 200*a*, 200*b* are connected to one another by fasteners being received through the connecting apertures 219*d*, and are connected to the rear hull panel 38 by fasteners being received through the connecting apertures 219*e* (FIGS. 7A, 7B and 12). In this embodiment, when the left and right acoustic panel sections 210*a*, 210*b* of a given one of the leading and trailing acoustic panels 200*a*, 200*b* are connected to one another, the inner lateral ends 230 thereof abut one another. Furthermore, as best shown in FIGS. 7A and 8, in this embodiment, the two acoustic panel sections 210*a*, 210*b* of a given one of the leading and trailing acoustic panels 200*a*, 200*b* are disposed such that their respective first and second longitudinal sides 236, 238 face opposite directions.

It is contemplated that in other embodiments, the leading and trailing acoustic panels 200*a*, 200*b* could be connected to other connecting portions of the boat 10 in addition or instead of the cross-beams. For instance, in some embodiments, other connecting portions of the boat 10 could be, for example, the walls 70, 72, 74, 75 of the rear hull panel 38, the lateral sections 34*a* of the rear hull cover 33 and/or other components within the engine compartment 100.

In this embodiment, since the leading and trailing acoustic panels 200*a*, 200*b* are connected to the leading and trailing cross-beams 35*a*, 35*c* respectively, the leading and trailing acoustic panels 200*a*, 200*b* are longitudinally aligned with components of the engine assembly 152 that are disposed under respective ones of the cross-beams 35*a*, 35*c*. For instance, in this embodiment, the leading acoustic panel 200*a* is longitudinally aligned with a portion of the fuel tank 162, whereas the trailing acoustic panel 200*b* is longitudinally aligned with a portion of the engine 168. It is contemplated that the longitudinal position of the leading and trailing acoustic panels 200*a*, 200*b* could vary from one embodiment to another. For instance, in an embodiment where the trailing cross-beam 35*c* is longitudinally further away from the leading and intermediate cross-beams 35*a*, 35*b*, the trailing acoustic panel 200*b* could be disposed longitudinally rearward from the engine 168. In another embodiment, the leading acoustic panel 200*a* and/or the trailing acoustic panel 200*b* could be connected to the rear hull panel 38 and could be, respectively, longitudinally offset from the fuel tank 162 and/or the engine 168. Additionally, a change in the positioning of the components of the engine assembly 152 could also result in the leading and trailing acoustic panels 200*a*, 200*b* being longitudinally offset from the fuel tank 162 and/or the engine 168 and being longitudinally aligned with other components of the engine assembly 152 (e.g., the airbox 164, the engine control module 166, the muffler 170 or the resonator 172).

As mentioned above, the leading and trailing acoustic panels 200*a*, 200*b*, which extend generally perpendicular to the longitudinal centerplane CP, partially divide the engine compartment 100 into a leading sub-compartment 201*a*, an intermediate sub-compartment 201*b* and a trailing sub-compartment 201*c*. The leading sub-compartment 201*a* is defined longitudinally between the rear surface of the bulkhead 106 and the front surface of the leading acoustic panel 200*a*. It is contemplated that in some embodiments, the bulkhead 106 could be omitted, such that the leading sub-compartment 201*a* is defined longitudinally between the front surface of the leading acoustic panel 200*a* to the front wall 72 of the rear hull panel 38. The intermediate sub-compartment 201*b* is defined longitudinally between the rear surface of the leading acoustic panel 200*a* and the front surface of the trailing acoustic panel 200*b*. The rear sub-compartment 201*c* is defined between the rear surface of the trailing acoustic panel 200*c* and the rear wall 74 of the rear hull panel 38. It is understood that in other embodiments in which a different number of acoustic panels is provided, the acoustic panels divide the engine compartment 100 in a different number of sub-compartments. The leading, intermediate and trailing engine sub-compartments 201*a*, 201*b*, 201*c* are communicatively connected to one another such that air can flow from one sub-compartment to another.

In this embodiment, a majority of the fuel tank 162 is disposed in the leading sub-compartment 201*a*; the airbox 164, the engine control module 166 and a majority of the engine 168 are disposed in the intermediate sub-compartment 201*b*; and the muffler 170 and the resonator 172 are disposed in the trailing sub-compartment 201*c*. As can be seen in FIG. 9, each of the sub-compartments 201*a*, 201*b*, 201*c* have respective lengths, measured in the longitudinal direction, which are all smaller than the engine compartment length $L_{EC}$. For instance, the intermediate sub-compartment 201*b* has a length $L_C$ that is less than the engine compartment length $L_{EC}$. As such, the acoustic panels 200*a*, 200*b* form sub-compartments that are smaller than the totality of the engine compartment 100, which can reduce the amount of noise and vibration generated within the engine compartment 100.

With reference to FIGS. 7A and 7B, the acoustic panels 200*a*, 200*b* take up a significant proportion of a cross-sectional area of the engine compartment 100 taken along a vertical plane perpendicular to the longitudinal direction (i.e., perpendicular to the longitudinal centerplane CP) without however stopping air flow between the sub-compartments 201*a*, 201*b*, 201*c*. In the present embodiment, as the top of the engine compartment 100 is defined by the rear hull cover 33, the cross-sectional area of the engine compartment 100 generally extends, in the vertical direction, from the bottom wall 70 to a bottom surface of the top section 34*b* of the rear hull cover 33 and generally extends, in the lateral direction, between the two opposite lateral walls 75. Since the shape of the rear hull panel 38 changes along the longitudinal direction, it is understood that the engine compartment cross-sectional area can vary along the longitudinal direction of the boat 10.

Thus, as shown for example in FIG. 7B, in a vertical plane 202 (FIGS. 6 and 10) that passes through a longitudinal center of the leading acoustic panel 200*a* and that is generally perpendicular to the longitudinal centerplane CP, the leading acoustic panel 200*a* occupies a significant part of the cross-sectional area of the engine compartment 100. In other words, the cross-sectional area of the leading acoustic panel 200*a* occupies a significant portion of the cross-sectional area of the engine compartment 100 taken along the vertical plane 202. Notably, if one were to trace a projection 152' (illustrated in dashed lines in FIG. 7B) of the engine assembly 152 on the vertical plane 202, including projections of all of the components of the engine assembly 152 including the engine 168, thereby defining an engine assembly cross-sectional area in the vertical plane 202, the part of the cross-sectional area of the engine compartment 100 that is occupied by the leading acoustic panel 200*a* in the vertical plane 202 corresponds to at least a majority of the cross-sectional area of the engine compartment 100 that is not occupied by the engine assembly cross-sectional area of the projection 152'. That is, of the part of the cross-sectional area of the engine compartment 100 in the vertical plane 202 that is not overlapped by the engine assembly cross-sectional area (defined by the projection 152'), the leading acoustic panel 200*a* occupies at least a majority thereof. It is to be understood that the illustration of the projection 152' in FIG. 7B is for illustrative purposes only. This relationship between the leading acoustic panel 200*a* and the cross-sectional area of the engine compartment 100 is similar for the trailing acoustic panel 200*b* and the cross-sectional of the engine compartment 100 on a vertical plane that passes through a longitudinal center of the trailing acoustic panel 200*b* and onto which a projection of the engine assembly 152 is traced.

It is to be understood that the projection 152' of the engine assembly 152 on the vertical plane 202 is a projection of the profile of the engine assembly 152 when the engine assembly 152 is viewed in an elevation view from the front or rear.

Furthermore, in this embodiment, as shown in FIG. 7B, the cross-sectional area of the leading acoustic panel 200*a* and the engine assembly cross-sectional area as defined by the projection 152' do not intersect. Notably, in this embodiment, the lower central recess 212 is dimensioned to leave an area clear between the leading acoustic panel 200*a* and the projection 152'. It is contemplated that, in other embodiments, the acoustic panel 200*a* could be dimensioned such that the lower central recess 212 is smaller and therefore the acoustic panel 200*a* more tightly surrounds the projection 152' of the engine assembly 152. For instance, in such embodiments, the leading acoustic panel 200*a* could occupy an entirety of the cross-sectional area of the engine compartment 100 that is not occupied by the engine assembly cross-sectional area defined by the projection 152'. In other words, the cross-sectional area of the leading acoustic panel 200*a* and the engine assembly cross-sectional area defined by the projection 152', without overlapping with one another, could encompass the entire cross-sectional area of the engine compartment 100. In yet other embodiments, the leading acoustic panel 200*a* could additionally occupy some of the cross-sectional area of the engine compartment 100 that is occupied by the engine assembly cross-sectional area defined by the projection 152'. In other words, the cross-sectional area of the leading acoustic panel 200*a* and the engine cross-sectional area at least partially overlap with one another in the vertical plane 202. In another embodiment, the engine assembly 152 could only include the engine 168, and, as such, the engine assembly cross-sectional area is defined solely by a projection 168' (illustrated in dashed lines in FIG. 7B) of the engine 168 on the vertical plane 202.

In some embodiments, instead of taking the projection 152' of the engine assembly 152 on the vertical plane 202, a projection of only some of the components of the engine assembly 152 in addition to the engine 168 on the vertical plane 202 could be taken to establish similar relationships between the acoustic panels 200*a*, 200*b*, the projection of those components of the engine assembly 152 including the engine 168 and the cross-sectional area of the engine compartment 100.

As will be understood from the above, the division of the engine compartment 100 into the sub-compartments 201*a*, 201*b*, 201*c* can help reduce the amount of noise and vibrations transmitted within the engine compartment 100. Notably, the distance that sounds waves must travel within the engine compartment 100 is reduced by the presence by the of the acoustic panels 200*a*, 200*b*. Furthermore, since the leading and trailing acoustic panels 200*a*, 200*b* are made of sound-absorbing material, the leading and trailing acoustic panels 200*a*, 200*b* absorb some of the high frequency sound waves emitted by the engine assembly 152, most notably the engine 168. This can further reduce noise and vibrations felt by passengers of the boat 10.

It is contemplated that, in some embodiments, a hull assembly could be provided on its own including solely the hull 30 and the components received within the interior volume of the hull 30 such as the components of the engine assembly 152 and the acoustic panels 200*a*, 200*b*. For instance, such a hull assembly could be manufactured for fitting with different types of decks. In such a scenario, the engine compartment 100 of the hull assembly is defined by the walls of the hull 30 (i.e., of the rear hull panel 38 in this embodiment) and its top is defined by the upper peripheral edge 80. As will be appreciated, the relationship between the acoustic panels 200*a*, 200*b*, the cross-sectional area of the engine compartment 100 and the projection 168' of the engine 168 described above is also applicable in such a scenario. Moreover, in such embodiments, the acoustic panels 200*a*, 200*b* could be connected directly to the walls of the hull 30 rather than the cross-beams 35*a*, 35*b*, 35*c*. For example, the acoustic panels 200*a*, 200*b* could be glued or otherwise fastened (e.g., via tie wraps) to the walls of the hull 30.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a deck;

a hull supporting the deck, the hull at least partly defining an engine compartment, the engine compartment having an engine compartment length measured along a longitudinal direction of the watercraft;

an engine assembly comprising at least an internal combustion engine, the engine assembly being disposed in the engine compartment, the engine having an engine length measured along the longitudinal direction of the watercraft, the engine length being less than half of the engine compartment length;

a drive system connected to the hull and configured for propelling the watercraft, the drive system being operatively connected to the engine in order to be powered by the engine; and at least one acoustic panel disposed in the engine compartment to partially divide the engine compartment into a plurality of sub-compartments in communication with one another, the at least one acoustic panel extending generally perpendicular to a longitudinal centerplane of the watercraft, and the at least one acoustic panel being connected to the hull with an upper portion of the at least one acoustic panel being connected to a connecting portion of the watercraft in order to hang the at least one acoustic panel from the connecting portion, and wherein, in a vertical plane perpendicular to the longitudinal centerplane and extending through the at least one acoustic panel:

the at least one acoustic panel occupies part of a cross-sectional area of the engine compartment;

a projection of the engine assembly on the vertical plane defines an engine assembly cross-sectional area; and the part of the cross-sectional area of the engine compartment that is occupied by the at least one acoustic panel corresponds to at least a majority of the cross-sectional area of the engine compartment that is not occupied by the engine assembly cross-sectional area.

2. The watercraft of claim 1, wherein the connecting portion is a cross-beam extending generally perpendicular to the longitudinal centerplane of the watercraft, the cross-beam being connected to the hull.

3. The watercraft of claim 1, wherein the engine assembly further comprises at least one of:

a fuel tank fluidly connected to the engine to provide fuel to the engine;

an airbox fluidly connected to the engine to provide air to the engine;

a muffler fluidly connected to the engine for reducing noise emitted by the engine;

a resonator fluidly connected to the engine for altering noise emitted by the engine; and an engine control module in communication with the engine for controlling operation of the engine.

4. The watercraft of claim 3, wherein the at least one acoustic panel defines a lower central recess configured to receive a portion of the engine assembly therein so that the at least one acoustic panel at least partially surrounds the engine assembly.

5. The watercraft of claim 1, wherein the at least one acoustic panel comprises a first acoustic panel and a second acoustic panel, the first and second acoustic panels being spaced from one another along the longitudinal direction of the watercraft.

6. The watercraft of claim 5, wherein the plurality of sub-compartments is three sub-compartments.

7. The watercraft of claim 6, wherein:

one of the plurality of sub-compartments is an intermediate sub-compartment defined between the first and second acoustic panels; and at least a majority of the engine is disposed in the intermediate sub-compartment.

8. The watercraft of claim 1, wherein the deck above the engine compartment is substantially flat.

9. The watercraft of claim 1, wherein the drive system is a jet propulsion system.

10. The watercraft of claim 1, wherein the part of the cross-sectional area of the engine compartment that is occupied by the at least one acoustic panel corresponds to at least an entirety of the cross-sectional area of the engine compartment that is not occupied by the engine assembly cross-sectional area, and the part of the cross-sectional area of the engine compartment that is occupied by the at least one acoustic panel overlaps part of the engine assembly cross-sectional area.

* * * * *